US006572433B1

(12) United States Patent
Hou

(10) Patent No.: US 6,572,433 B1
(45) Date of Patent: Jun. 3, 2003

(54) PRAYER DOLL TOY STRUCTURE

(76) Inventor: Chin-Jung Hou, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/047,358

(22) Filed: Jan. 11, 2002

(51) Int. Cl.[7] ..... A63H 11/00
(52) U.S. Cl. ..... 446/353; 446/330
(58) Field of Search ..... 446/268, 330, 446/331, 376, 353, 136, 139; 40/411, 414, 415, 418, 420

(56) References Cited

U.S. PATENT DOCUMENTS 4,869,703 A * 9/1989 Ong ..... 446/353
4,901,459 A * 2/1990 Lee ..... 40/414
5,147,238 A * 9/1992 Kelley et al. ..... 446/330
5,224,896 A * 7/1993 Terzian ..... 446/355
5,735,726 A * 4/1998 Cohen ..... 446/298
5,941,756 A * 8/1999 Chou ..... 446/330
6,163,992 A * 12/2000 Chou ..... 40/411
6,200,191 B1 * 3/2001 Chou ..... 446/353
6,439,952 B1 * 8/2002 Yamamura ..... 446/383

* cited by examiner

*Primary Examiner*—Jacob K. Ackun
*Assistant Examiner*—Faye Francis

(57) ABSTRACT

A prayer doll toy structure includes a base, a base drive set, a lower body skeleton, a lower body drive set, an upper body skeleton, an upper body drive set, a head, and a shade. Thus, the prayer doll toy structure may kneel on the pad, to simulate the human body to pray, thereby achieving an amusement effect.

20 Claims, 16 Drawing Sheets

PRAYER DOLL TOY STRUCTURE

BACKGROUND OF THE INVENTION

1. Field of the Invention

The present invention relates to a prayer doll toy structure, and more particularly to a prayer doll toy structure that may kneel on the pad, to simulate the human body to pray, thereby achieving an amusement effect.

2. Description of the Related Art

A conventional toy structure in accordance with the prior art cannot actually simulate the real action according to the pattern of the toy structure itself. Most of the toy structure can only provide a single playing effect, and the manufacturer does not pay attention to the quality of the toy structure so that it is difficult to enhance the value of the toy structure. In addition, the conventional toy cannot enhance the true activity and mobility of its head, hands, and the like, thereby greatly limiting the versatility of the conventional toy.

SUMMARY OF THE INVENTION

The present invention has arisen to mitigate and/or obviate the disadvantage of the conventional toy structure.

The primary objective of the present invention is to provide a prayer doll toy structure that may kneel on the pad, to simulate the human body to pray, thereby achieving an amusement effect.

In accordance with the present invention, there is provided a prayer doll toy structure, comprising: a base, a base drive set, a lower body skeleton, a lower body drive set, an upper body skeleton, an upper body drive set, a head, and a shade, wherein:

the base includes a base lower case, and a base cover plate, the base lower case has an inside formed with a battery chamber facing downward, the base cover plate is secured on a top of the base lower case and has a rear edge formed with two rectangular recesses, each of the two rectangular recesses has a front side wall and a bottom side wall each formed with an opening;

the base drive set is mounted in the base, and is screwed on the bottom of the base cover plate, the base drive set includes a gear box that is divided into two halves, the gear box is provided with a first motor which may drive and rotate two belt wheels by a belt mounted outside of the gear box, to in turn drive and rotate a first reduction gear, a second reduction gear, a third reduction gear, a fourth reduction gear, and a fifth reduction gear mounted in the gear box, the fifth reduction gear may drive and rotate two transfer gears that are mounted outside of the gear box, and are co-axial with the fifth reduction gear, each of the two transfer gears is received in the opening of each of the two recesses of the base cover plate;

the lower body skeleton is a two-leg structure symmetrically fixed above the base, and includes two positioning blocks, two shank covers, two thigh covers, two torsion springs, two frame plates, and a tensile spring;

the two positioning blocks are symmetrically secured in the recess of the base cover plate, the two positioning blocks are matingly provided with a threaded post and a screw bore, and are matingly provided with a lug and a cavity located above the threaded post and the screw bore respectively, one of the two positioning blocks has an outer side having an edge provided with a tube;

the two shank covers form the housing of the left shank or the right shank of the doll, each of the two shank covers is provided with a concave joint portion which has a center formed with a through hole for passage of a spindle, the joint portion is formed with an arcuate slot located under the through hole for passage of a passage rod, and multiple insertion holes arranged in a curved manner;

the two thigh covers may form the housing of the left thigh or the right thigh of the doll, each of the two thigh covers has an inner side having a lower end having a center provided with a circular lug formed with a central hole for passage of the spindle, so that the two thigh covers may be pivoted on the two shank covers, each of the two thigh covers is provided with a short post located above the circular lug, each of the two thigh covers has an upper end having a center formed with a screw bore into which a screw member may be screwed, one of the two thigh covers is formed with an arcuate slot located under the screw bore, and is provided with a stepped threaded rod located under the arcuate slot;

the torsion spring is mounted between the shank cover and the thigh cover, and has a mediate section mounted on the circular lug of the thigh cover, the torsion spring has an upper section formed with a ring secured on the short post located above the circular lug of the thigh cover, the torsion spring has a lower section which is inserted into the insertion hole of the joint portion of the shank cover;

The two frame plates are mounted above the thigh covers, and are connected with each other by a threaded post, the frame plate has a lower end formed with a screw bore which is aligned with the screw bore of the thigh cover for passage of a screw member, so that the frame plate may be secured on the thigh cover at an inner side, the frame plate is formed with a circular hole located beside the screw bore, the circular hole is aligned with the arcuate slot of one thigh cover for passage of a short rod, the frame plate has an inner side having an edge and has an outer side having a center each secured with a U-shaped block, the inner side of one frame plate is provided with a stepped threaded rod located under the U-shaped block;

the tensile spring has an upper end formed with a ring mounted on the stepped threaded rod of one frame plate, and a lower end formed with a ring mounted on the stepped threaded rod of one thigh cover;

the lower body drive set is mounted in the lower body skeleton, and includes a gear, a sector-shaped plate, a lower link, a connecting plate, a pinion, and an upper link;

the gear has a center mounted on the threaded post of the positioning block, and meshes with the transfer gear of the base drive set;

the sector-shaped plate has a lower end pivotally mounted on the lug of the positioning block, and provided with multiple sector-shaped teeth meshing with the gear, the sector-shaped plate has an upper end formed with two screw bores for passage of screw members, so that the sector-shaped plate may be secured with the lower end of one shank cover;

the lower link is mounted in the shank cover, and has a lower end formed with a mounting hole mounted on the tube of one positioning block, and an upper end for passage of the passage rod of the joint portion of the shank cover;

the connecting plate is mounted on the upper end of the lower link, and has two ends each formed with a circular hole for passage of the spindle and the passage rod;

the pinion is mounted beside the connecting plate, and has a center mounted on the spindle;

the upper link is mounted in the thigh cover, and has a lower end mounted on the passage rod of the shank cover and formed with multiple engaging teeth meshing with the pinion, and an upper end mounted on the short rod which is extended through the arcuate slot of the thigh cover;

the upper body skeleton is mounted above the lower body skeleton, and includes two upper body casings, two arms, and two arm skeletons;

the two upper body are provided with multiple threaded posts for passage of screw members, for securing the two upper body casings, each of the two upper body casings has a mediate section formed with two spaced through holes, an upper section formed with an upper cutout, and two sides each formed with a side cutouts;

each of the two arms has a root portion formed with a concave, the root portion of each of the two arms has an inner side formed with a cutout located under the concave;

each of the two arm skeletons has a front section received in the cutout of the arm, each of the two arm skeletons has a mediate section having a top and a bottom each protruded with a positioning rod, each of the two arm skeletons has a rear section formed with an oblong slot;

the upper body drive set is mounted in the upper body casings of the upper body skeleton, and includes a gear seat, an eccentric wheel, a slide plate, a drive block , and two upper body connecting frames;

the gear seat is provided with multiple plunger rods that may be inserted into the through holes of the upper body casings of the upper body skeleton, thereby achieving a positioning effect, the gear seat has a bottom provided with multiple long threaded posts screwed on the U-shaped blocks of the frame plates, so that the gear seat may be secured on the frame plates, an upright second motor is mounted between two long threaded posts, for driving and rotating a sixth reduction gear, a seventh reduction gear, an eighth reduction gear, a ninth reduction gear, a tenth reduction gear, and an eleventh reduction gear that are mounted in the gear seat, the gear seat has a top having two sides each provided with two parallel slide tracks, wherein an outer slide track is higher than an inner slide track, the top of the gear seat has four corners provided with four short threaded posts located outside of the slide tracks, the top of the gear seat is provided with two sleeves each located between two adjacent short threaded posts, the positioning rod at the bottom of each of the two arm skeletons is mounted in the sleeve;

the eccentric wheel is mounted on the top of the gear seat, and is co-axial with the eleventh reduction gear, an eccentric shaft is secured on a periphery of a top of the eccentric wheel;

the slide plate is slidably mounted on the slide tracks at the inner side of the gear seat, and is retained by the slide tracks at the outer side of the gear seat, the slide plate has a center formed with an oblong slot in which the eccentric shaft of the eccentric wheel is received, and provided with a threaded post located beside the oblong slot and received in the oblong slot of each of the two arm skeletons, the slide plate has a rear end formed with a small hole and having a bottom provided with a push plate;

the drive block is screwed on a top of the threaded post of the slide plate, and has two sides each provided with a tapered drive plate;

the two upper body connecting frames are symmetrically screwed on the top of the gear seat, each of the two upper body connecting frames has a bottom provided with two threaded posts matingly screwed on the short threaded posts of the gear seat, and a sleeve located between the two threaded posts, the positioning rod at the top of each of the two arm skeletons is mounted in the sleeve of each of the two upper body connecting frames, the bottom of each of the two upper body connecting frames is provided with two limit rods that are slightly spaced from the slide plate, each of the two upper body connecting frames has a top provided with an upright plate formed with a circular hole for passage of a passage rod;

the head is mounted above the upper body skeleton, and includes a head fixing rack, a head housing, an eye-socket rack, two eye sockets, two eyeballs, a tensile spring, a pull rope, and hair;

the head fixing rack includes a circular plate having a bottom provided with two parallel rack plates each rested on the inner side of the upright plate of each of the two upper body connecting frames, each of the two parallel rack plates has an upper end formed with a mounting hole aligned with the circular hole of the upright plate of each of the two upper body connecting frames for passage of the passage rod, so that the head fixing rack may be fixed on the two upper body connecting frames, each of the two parallel rack plates has a lower end formed with a slit for receiving the two drive plates of the drive block, a transverse bolt rod is mounted between the two parallel rack plates, the circular plate of the head fixing rack has a top provided with a ring seat having a lower portion formed with a small hole, and an upper portion formed with two opposite through holes for passage of a transverse rod;

the head housing is formed with two spaced eye holes;

the eye-socket rack is mounted in the head housing and has a mediate section formed with a hook hole, and has two distal ends each secured with a cross-shaped protruding rib;

each of the two eye sockets has a rear end formed with a cross-shaped recess for receiving the protruding rib of the eye-socket rack, each of the two eye sockets has a lower edge having a center formed with a channel, and has two sides each having a front edge formed with a cavity;

each of the two eyeballs is mounted on the front end of the eye socket, and is fixed by a screw member which is screwed into the cavity of each of the two sides of the eye socket, each of the two eyeballs has a front portion received in the eye hole of the head housing;

the tensile spring has an upper end secured in the hook hole of the eye-socket rack, and a lower end secured on the transverse rod of the ring seat of the head fixing rack;

the pull rope has a first end passed through the channel of the eye socket and secured on the eye socket, the pull rope has a second end in turn passed through the small hole of the ring seat of the circular plate of the head fixing rack, the transverse bolt rod between the two parallel rack plates, the drive block between the two drive plates, and through the small hole of the slide plate, and is finally secured on a rear portion of the gear seat.

Further benefits and advantages of the present invention will become apparent after a careful reading of the detailed description with appropriate reference to the accompanying drawings.

DETAILED DESCRIPTION OF THE INVENTION

Figure 1:
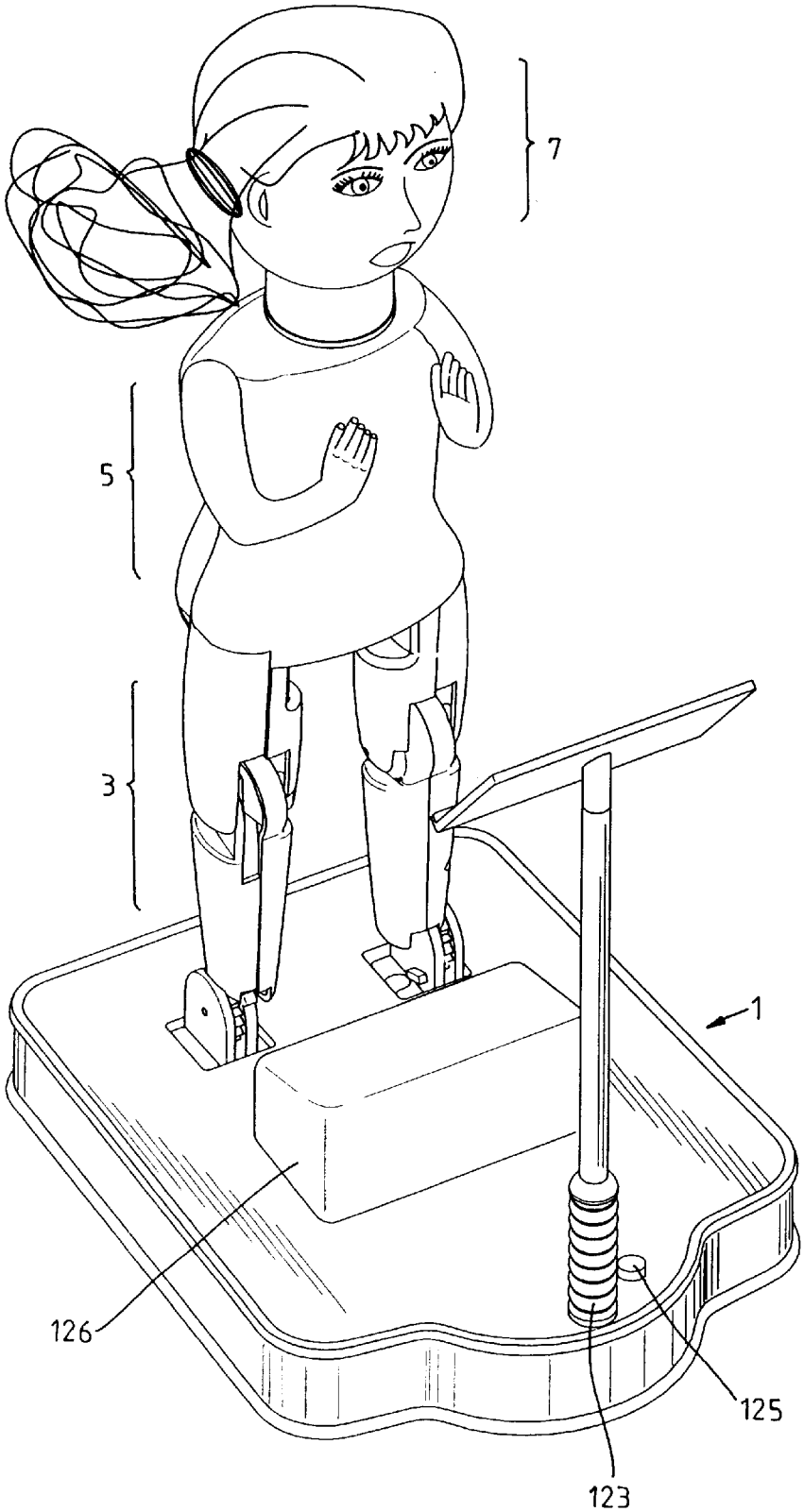
FIG. 1 is a perspective view of a prayer doll toy structure in accordance with a preferred embodiment of the present invention.
Figure 2:
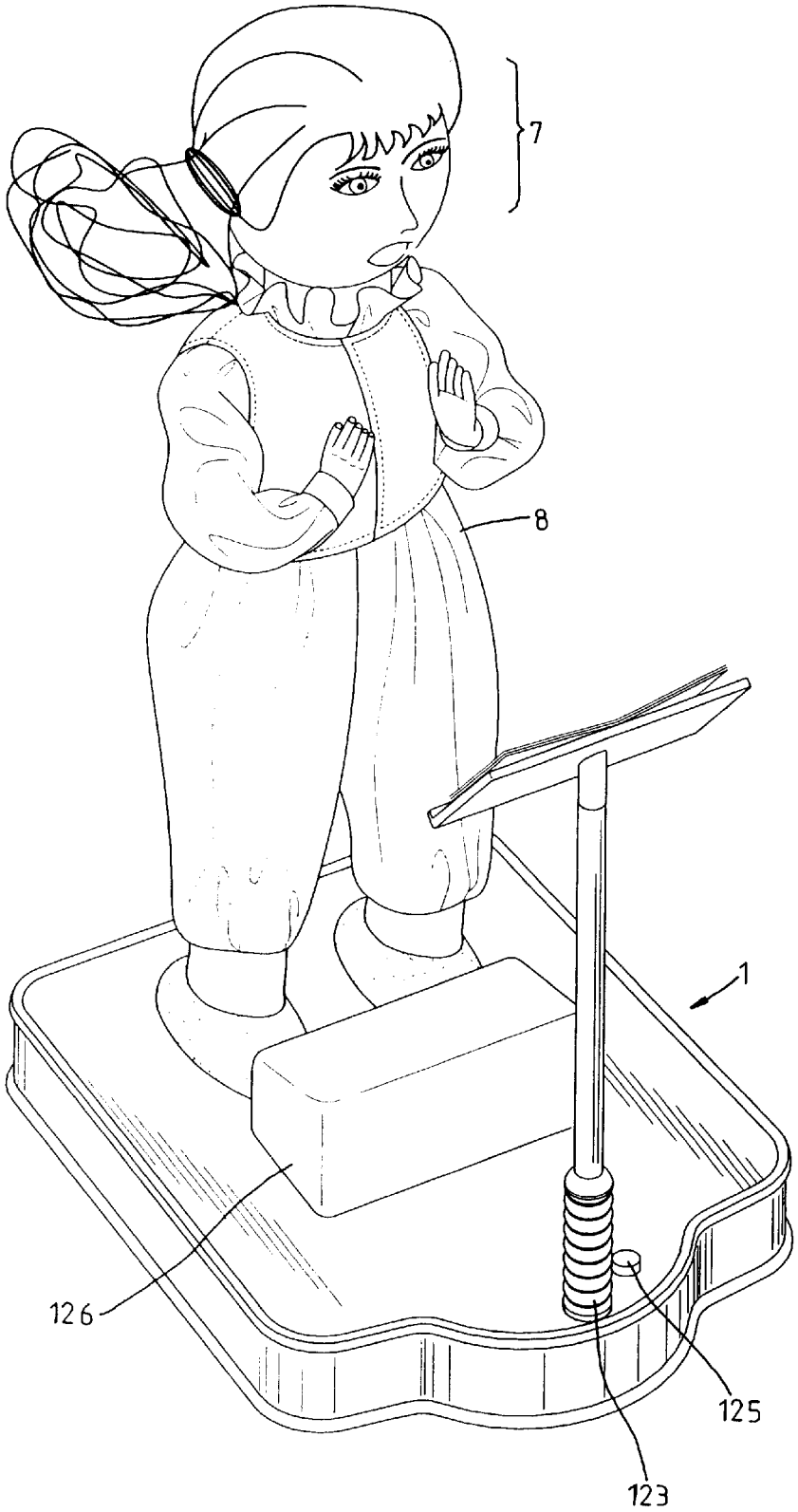
FIG. 2 is a perspective view of a prayer doll toy structure in accordance with a preferred embodiment of the present invention.
Figure 3:
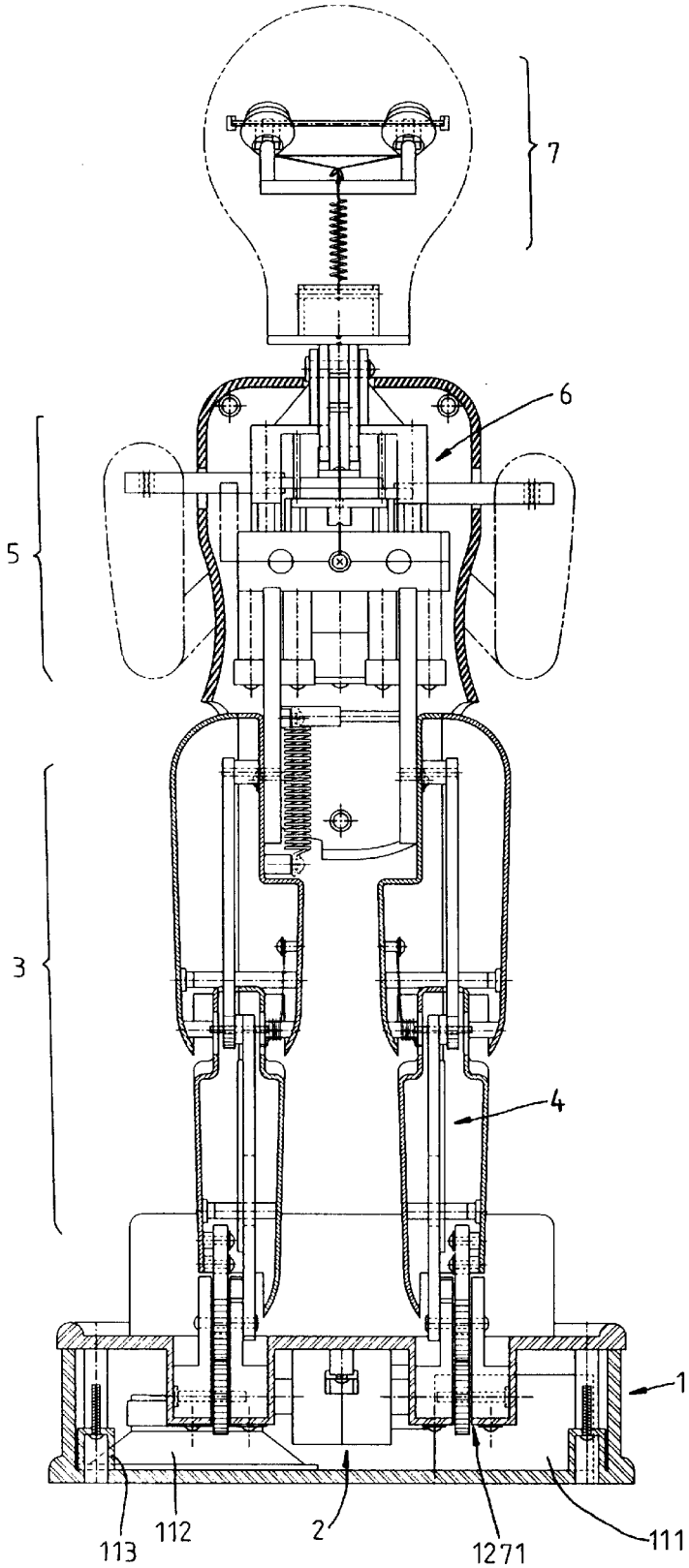
FIG. 3 is a rear plan cross-sectional view of the prayer doll toy structure as shown in FIG. 1.

Referring to the drawings and initially to FIGS. 1–3, a prayer doll toy structure in accordance with a preferred embodiment of the present invention comprises a base 1, a base drive set 2, a lower body skeleton 3, a lower body drive set 4, an upper body skeleton 5, an upper body drive set 6, a head 7, and a shade 8.

Figure 4:
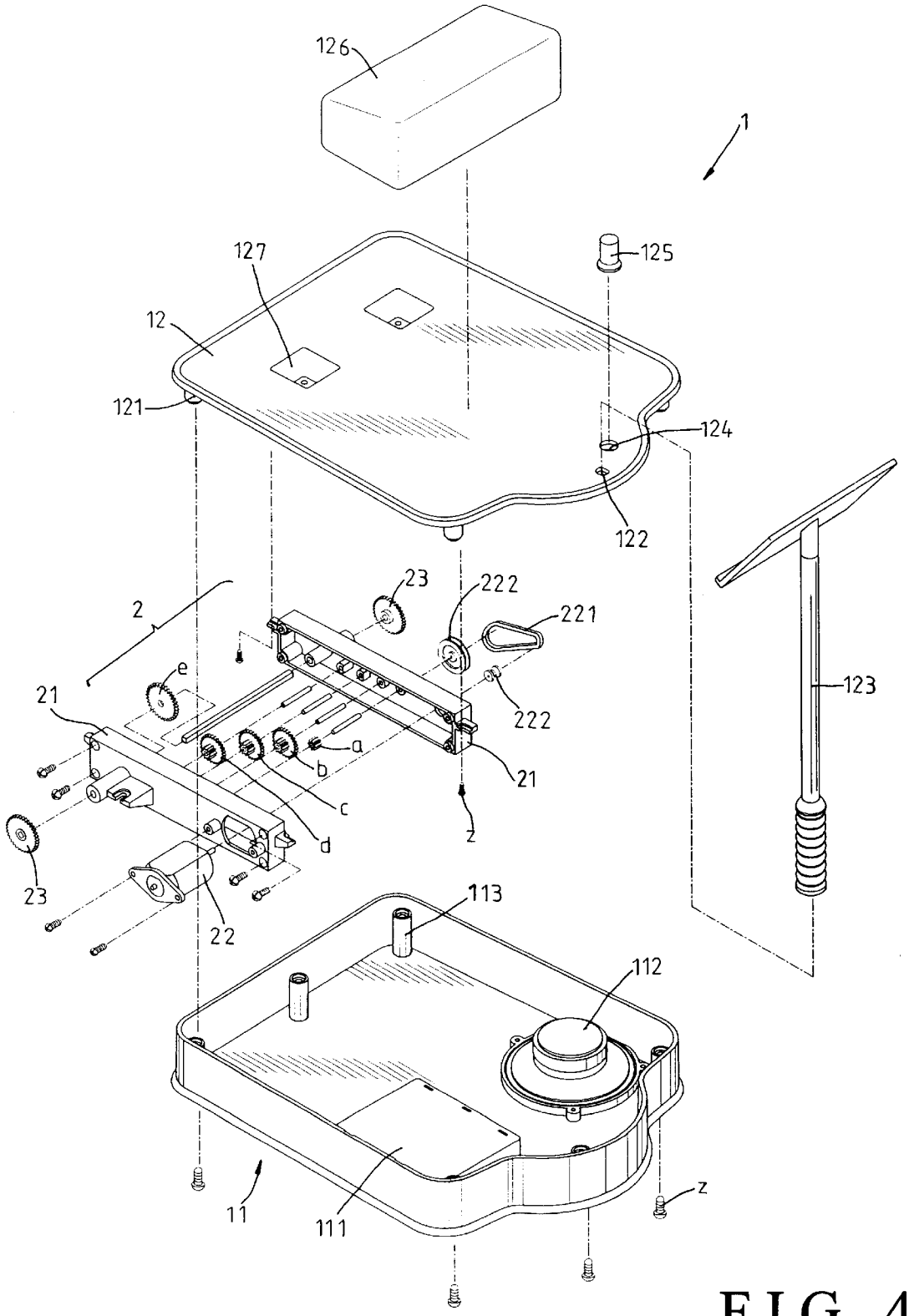
FIG. 4 is an exploded perspective view of a base of the prayer doll toy structure in accordance with a preferred embodiment of the present invention.

As shown in FIGS. 3 and 4, the base 1 includes a base lower case 11, and a base cover plate 12.

The base lower case 11 has an inside formed with a battery chamber 111 facing downward, and provided with a horn 112 located beside the battery chamber 111. The inside of the base lower case 11 is provided with multiple threaded posts 113.

The base cover plate 12 is secured on a top of the base lower case 11, and has a bottom provided with multiple threaded posts 121 aligned with the threaded posts 113 of the base lower case 11 for passage of multiple screw members "Z", thereby combining the base lower case 11 with the base cover plate 12. The base cover plate 12 has a front edge having a center formed with an insertion hole 122 for insertion of a shelf 123, and a circular hole 124 located beside the insertion hole 122, for passage of the push button 125 from a lower side. The base cover plate 12 has a rear edge formed with two rectangular recesses 127. Each of the two rectangular recesses 127 has a front side wall and a bottom side wall each formed with an opening 1271. A rectangular pad 126 is secured on a mediate section of the base cover plate 12.

Figure 5:
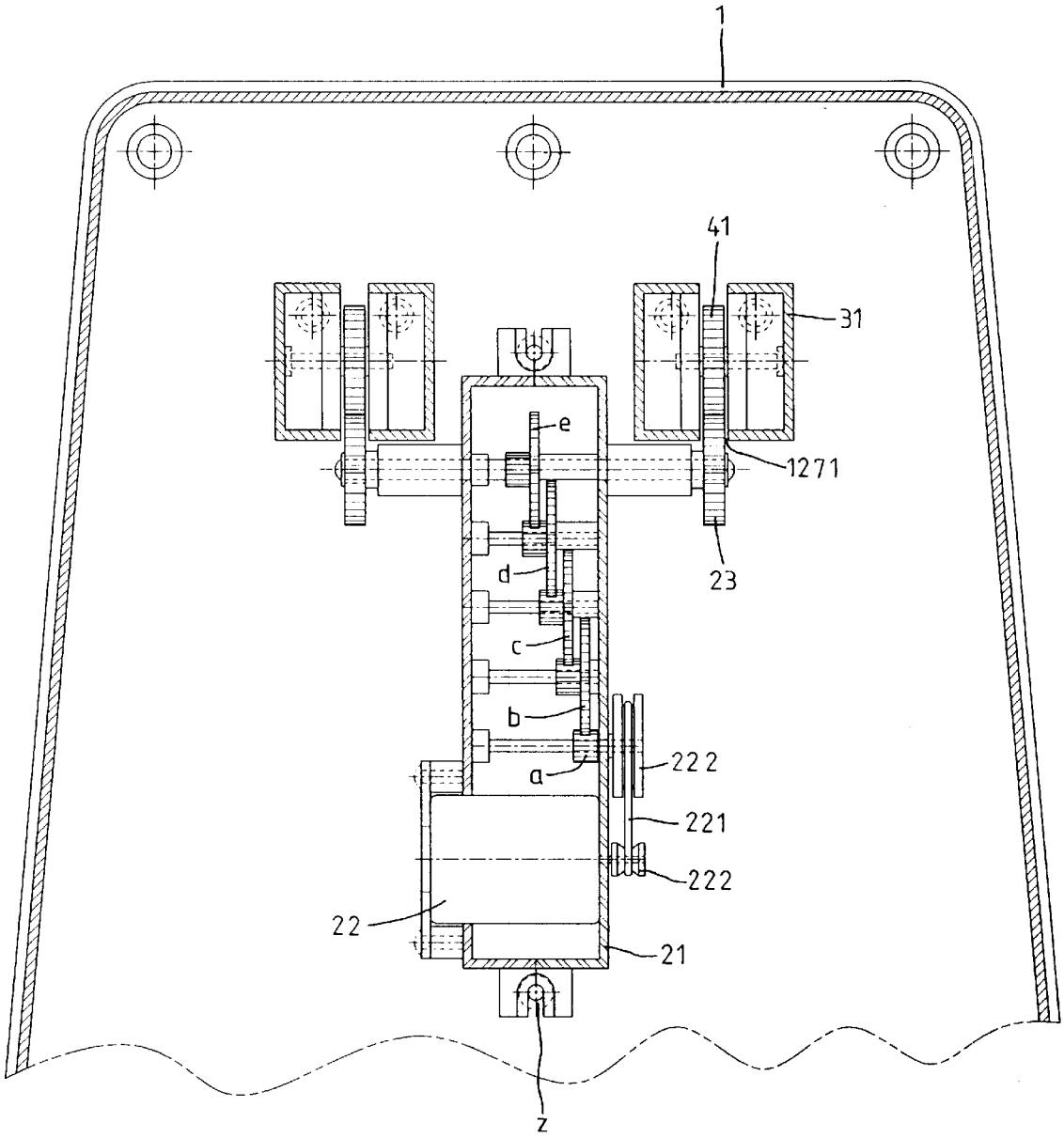
FIG. 5 is a top plan cross-sectional assembly view of the prayer doll toy structure as shown in FIG. 4.

As shown in FIGS. 3–5, the base drive set 2 is mounted in the base 1, and is screwed on the bottom of the base cover plate 12.

The base drive set 2 includes a gear box 21 that is divided into two halves. The gear box 21 is provided with a first motor 22 which may drive and rotate two belt wheels 222 by a belt 221 mounted outside of the gear box 21, to in turn drive and rotate a first reduction gear a, a second reduction gear b, a third reduction gear c, a fourth reduction gear d, and a fifth reduction gear e mounted in the gear box 21. The fifth reduction gear e may drive and rotate two transfer gears 23 that are mounted outside of the gear box 21, and are co-axial with the fifth reduction gear e. Each of the two transfer gears 23 is received in the opening 1271 of each of the two recesses 127 of the base cover plate 12.

Figure 6:
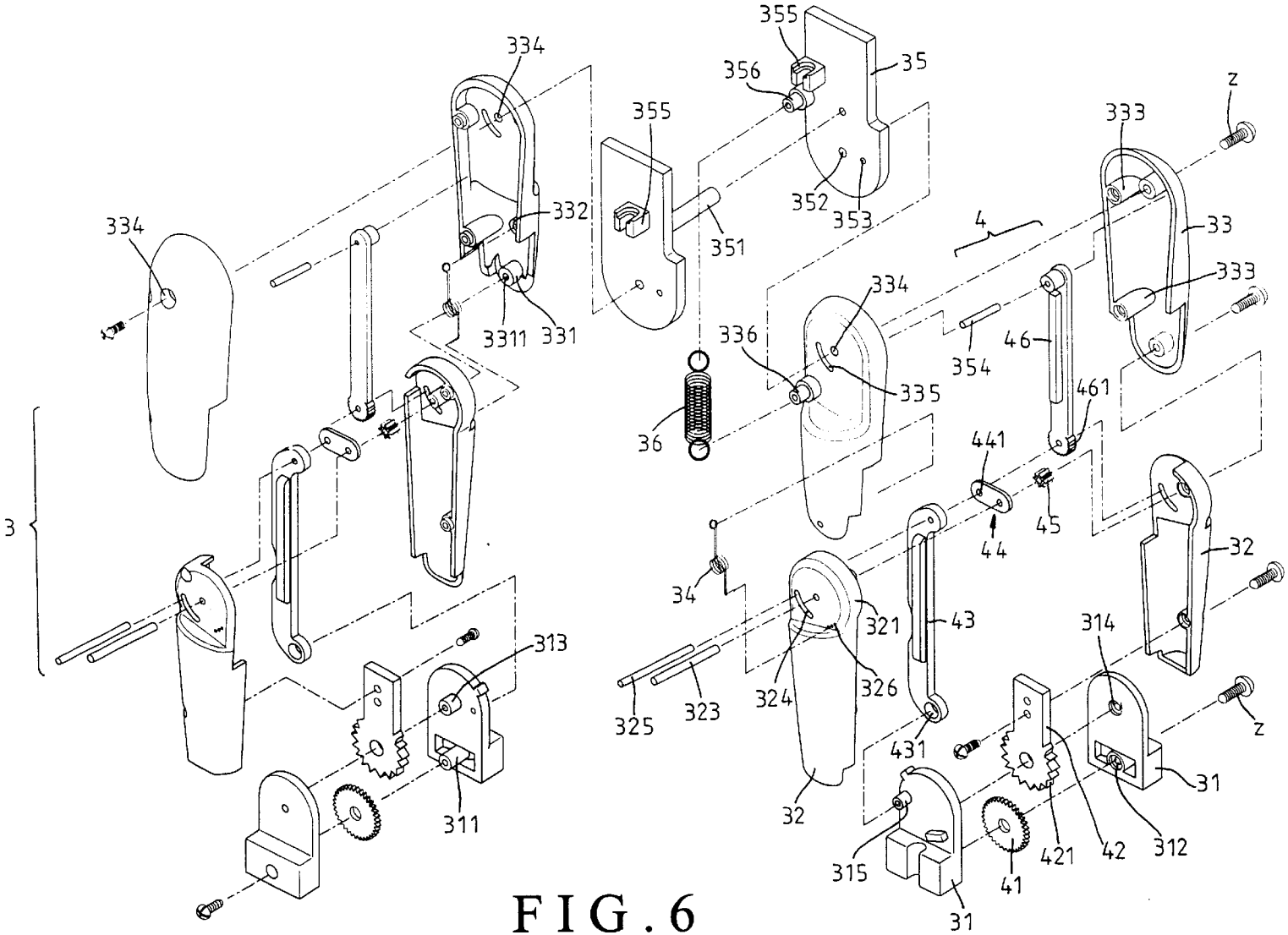
FIG. 6 is an exploded perspective view of a lower body skeleton of the prayer doll toy structure in accordance with a preferred embodiment of the present invention.
Figure 7:
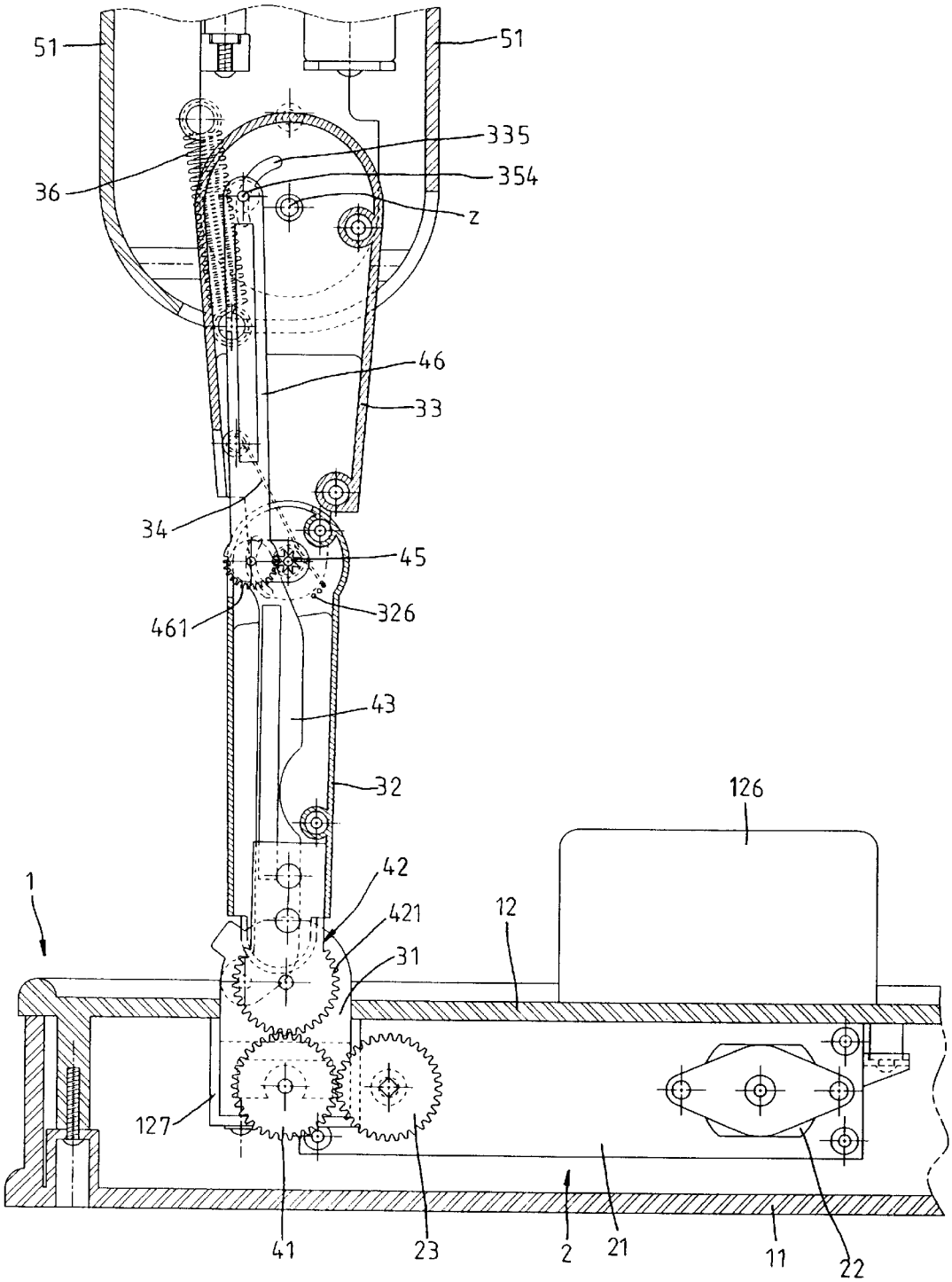
FIG. 7 is a side plan cross-sectional assembly view of the prayer doll toy structure as shown in FIG. 6.

As shown in FIGS. 3, 6 and 7, the lower body skeleton 3 is a two-leg structure symmetrically fixed above the base 1, and includes two positioning blocks 31, two shank covers 32, two thigh covers 33, two torsion springs 34, two frame plates 35, and a tensile spring 36.

Each of the two positioning blocks 31 is L-shaped. The two positioning blocks 31 are symmetrically secured in the recess 127 of the base cover plate 12. The two positioning blocks 31 are matingly provided with a threaded post 311 and a screw bore 312, and are matingly provided with a lug 313 and a cavity 314 located above the threaded post 311 and the screw bore 312 respectively. One of the two positioning blocks 31 has an outer side having an edge provided with a tube 315.

The two shank covers 32 may form the housing of the left shank or the right shank of the doll. Each of the two shank covers 32 is provided with a concave joint portion 321 which has a center formed with a through hole 322 for passage of a spindle 323. The joint portion 321 is formed with an arcuate slot 324 located under the through hole 322 for passage of a passage rod 325, and multiple insertion holes 326 arranged in a curved manner.

The two thigh covers 33 may form the housing of the left thigh or the right thigh of the doll. Each of the two thigh covers 33 has an inner side having a lower end having a center provided with a circular lug 331 formed with a central hole 3311 for passage of the spindle 323, so that the two thigh covers 33 may be pivoted on the two shank covers 32. Each of the two thigh covers 33 is provided with a short post 332 located above the circular lug 331. The inner side of each of the two thigh covers 33 is provided with multiple threaded posts 333 into which multiple screw members Z may be screwed to fix the two thigh covers 33. Each of the two thigh covers 33 has an upper end having a center formed with a screw bore 334 into which a screw member Z may be screwed. One of the two thigh covers 33 is formed with an arcuate slot 335 located under the screw bore 334, and is provided with a stepped threaded rod 336 located under the arcuate slot 335.

The torsion spring 34 is mounted between the shank cover 32 and the thigh cover 33, and has a mediate section mounted on the circular lug 331 of the thigh cover 33. The torsion spring 34 has an upper section formed with a ring secured on the short post 332 located above the circular lug 331 of the thigh cover 33 by a screw member Z, thereby fixing the upper section of the torsion spring 34. The torsion spring 34 has a lower section which is bent with 90 degrees and is inserted into the insertion hole 326 of the joint portion 321 of the shank cover 32.

The two frame plates 35 are mounted above the thigh covers 33, and are connected with each other by a threaded post 351. The frame plate 35 has a lower end formed with a screw bore 352 which is aligned with the screw bore 334 of the thigh cover 33 for passage of a screw member Z, so that the frame plate 35 may be secured on the thigh cover 33 at an inner side. The frame plate 35 is formed with a circular hole 353 located beside the screw bore 352. The circular hole 353 is aligned with the arcuate slot 335 of one thigh cover 33 for passage of a short rod 354. The frame plate 35 has an inner side having an edge and has an outer side having a center each secured with a U-shaped block 355. The inner side of one frame plate 35 is provided with a stepped threaded rod 356 located under the U-shaped block 355.

The tensile spring 36 has an upper end formed with a ring mounted on the stepped threaded rod 356 of one frame plate 35, and a lower end formed with a ring mounted on the stepped threaded rod 336 of one thigh cover 33.

The lower body drive set 4 is mounted in the lower body skeleton 3, and includes a gear 41, a sector-shaped plate 42, a lower link 43, a connecting plate 44, a pinion 45, and an upper link 46.

The gear 41 has a center mounted on the threaded post 311 of the positioning block 31, and meshes with the transfer gear 23 of the base drive set 2.

The sector-shaped plate 42 has a lower end pivotally mounted on the lug 313 of the positioning block 31, and provided with multiple sector-shaped teeth 421 meshing with the gear 41. The sector-shaped plate 42 has an upper end formed with two screw bores 422 for passage of screw members Z, so that the sector-shaped plate 42 may be secured with the lower end of one shank cover 32.

The lower link 43 is mounted in the shank cover 23, and has a lower end formed with a mounting hole 431 mounted on the tube 315 of one positioning block 31, and an upper end for passage of the passage rod 325 of the joint portion 321 of the shank cover 32.

The connecting plate 44 is an oblong plate mounted on the upper end of the lower link 43, and has two ends each formed with a circular hole 441 for passage of the spindle 323 and the passage rod 325.

The pinion 45 is mounted beside the connecting plate 44, and has a center mounted on the spindle 323.

The upper link 46 is mounted in the thigh cover 33, and has a lower end mounted on the passage rod 325 of the shank cover 32 and formed with multiple engaging teeth 461 meshing with the pinion 45, and an upper end mounted on the short rod 354 which is extended through the arcuate slot 335 of the thigh cover 33.

Figure 8:
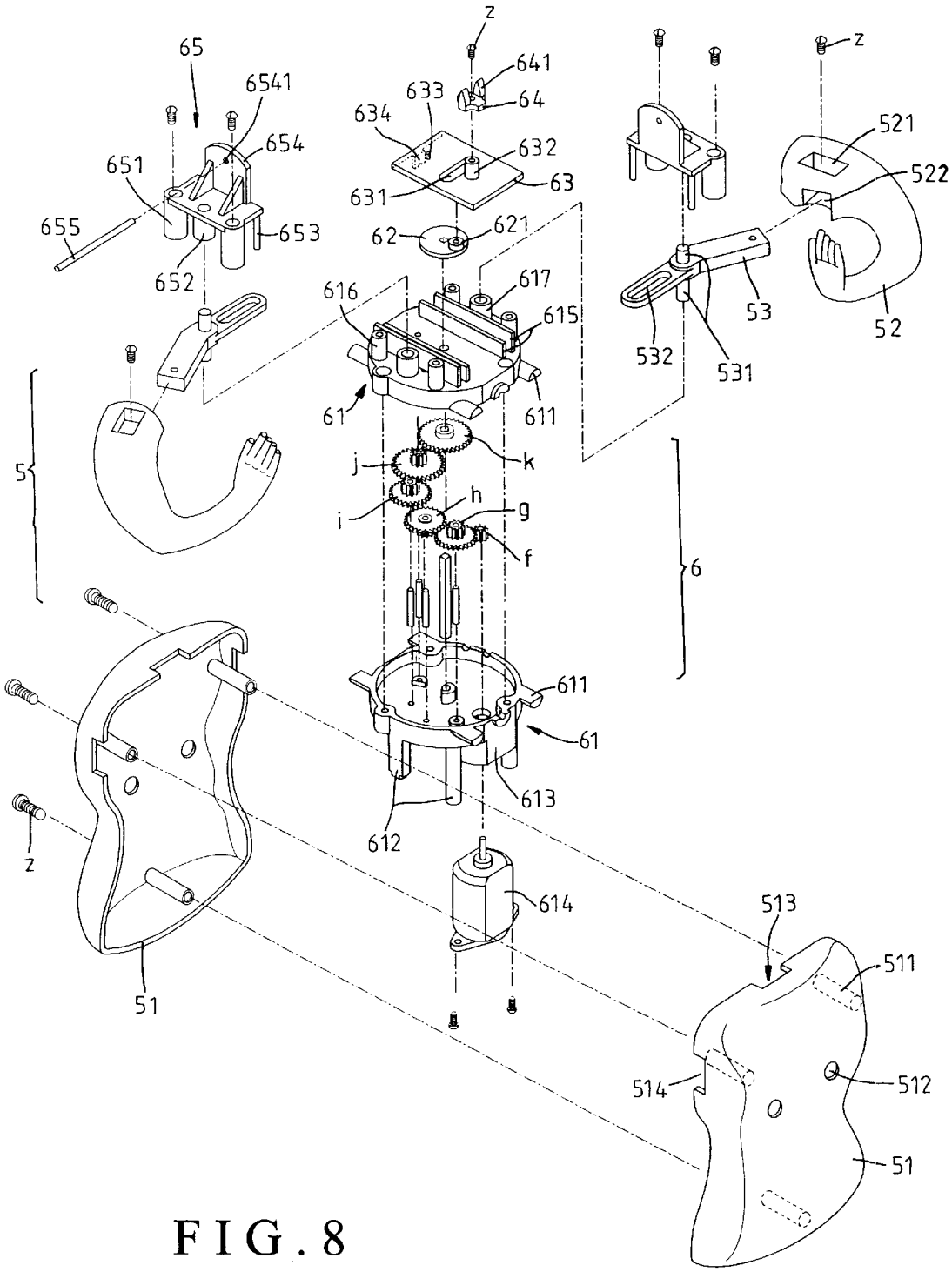
FIG. 8 is an exploded perspective view of an upper body skeleton of the prayer doll toy structure in accordance with a preferred embodiment of the present invention.
Figure 9:
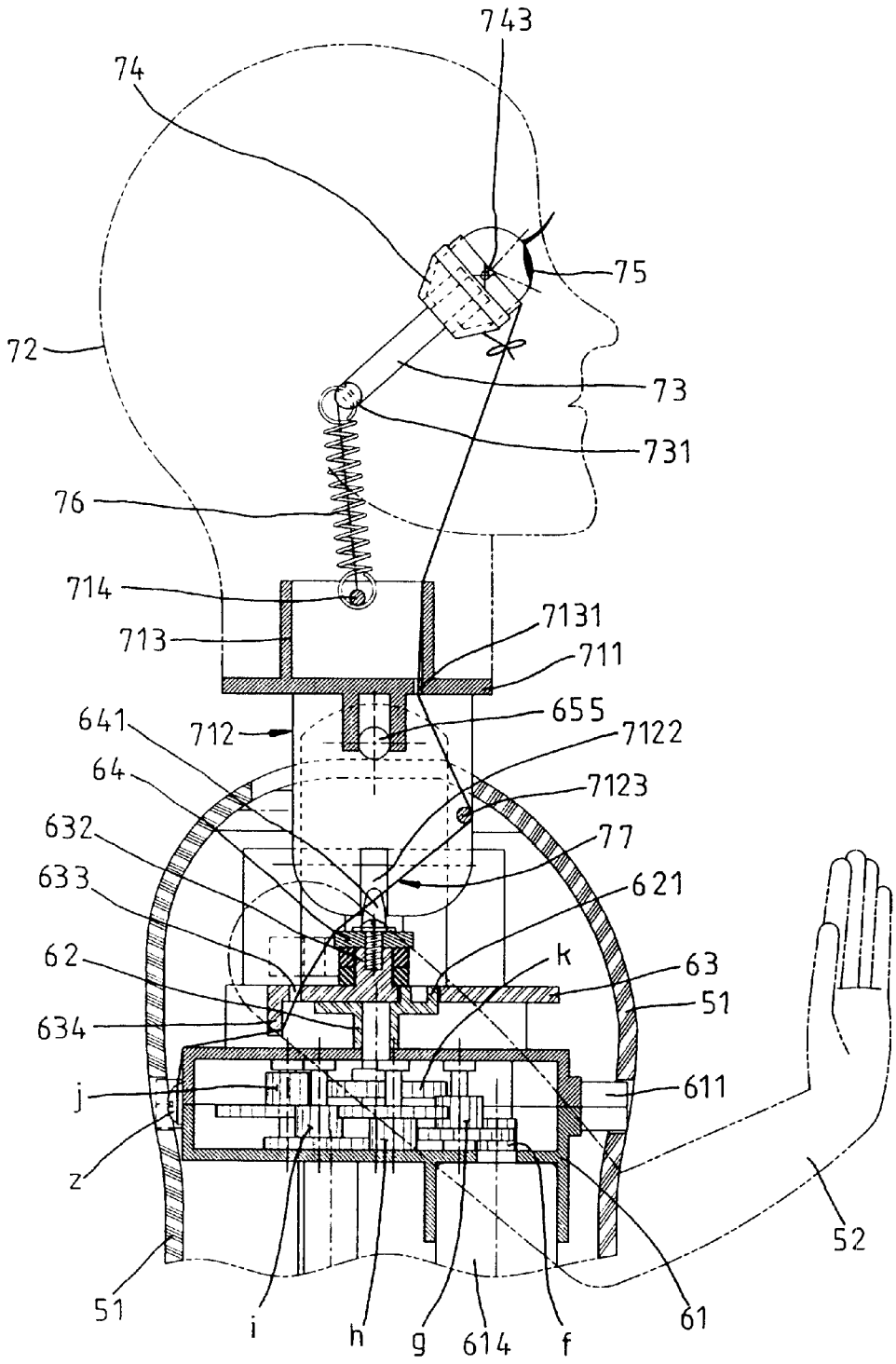
FIG. 9 is a side plan cross-sectional assembly view of the prayer doll toy structure as shown in FIG. 8.

As shown in FIGS. 3, 8 and 9, the upper body skeleton 5 is mounted above the lower body skeleton 3, and includes two upper body casings 51, two arms 52, and two arm skeletons 53.

The two upper body casings 51 may be combined with each other to form the upper body of the doll, and are provided with multiple threaded posts 511 for passage of screw members Z, for securing the two upper body casings 51. Each of the two upper body casings 51 has a mediate section formed with two spaced through holes 512, an upper section formed with an upper cutout 513, and two sides each formed with a side cutouts 514.

Each of the two arms 52 is bent, and has a root portion formed with a concave 521. The root portion of each of the two arms 52 has an inner side formed with a cutout 522 located under the concave 521.

Each of the two arm skeletons 53 is a substantially V-shaped plate that is connected with the respective arm 52, and has a front section received in the cutout 522 of the arm 52, and a screw member Z is extended through the concave 521 and is screwed into the front section of each of the two arm skeletons 53, thereby securing the arm 52 on the front section of each of the two arm skeletons 53. Each of the two arm skeletons 53 has a mediate section having a top and a bottom each protruded with a positioning rod 531. Each of the two arm skeletons 53 has a rear section formed with an oblong slot 532.

The upper body drive set 6 is mounted in the upper body casings 51 of the upper body skeleton 5, and includes a gear seat 61, an eccentric wheel 62, a slide plate 63, a drive block 64, and two upper body connecting frames 65.

The gear seat 61 is a circular hollow housing that is divided into an upper half and a lower half which may be combined with each other. The gear seat 61 is provided with multiple plunger rods 611 that may be inserted into the through holes 512 of the upper body casings 51 of the upper body skeleton 5, thereby achieving a positioning effect. The gear seat 61 has a bottom provided with multiple long threaded posts 612 screwed on the U-shaped blocks 355 of the frame plates 35, so that the gear seat 61 may be secured on the frame plates 35. An upright second motor 614 is mounted between two long threaded posts 612, for driving and rotating a sixth reduction gear f, a seventh reduction gear g, an eighth reduction gear h, a ninth reduction gear i, a tenth reduction gear j, and an eleventh reduction gear k, that are mounted in the gear seat 61. The gear seat 61 has a top having two sides each provided with two parallel slide tracks 615, wherein an outer slide track 615 is higher than an inner slide track 615. The top of the gear seat 61 has four corners provided with four short threaded posts 616 located outside of the slide tracks 615. The top of the gear seat 61 is provided with two sleeves 617 each located between two adjacent short threaded posts 616. The positioning rod 531 at the bottom of each of the two arm skeletons 53 is mounted in the sleeve 617.

The eccentric wheel 62 is mounted on the top of the gear seat 61, and is co-axial with the eleventh reduction gear k. An eccentric shaft 621 is secured on a periphery of a top of the eccentric wheel 62.

The slide plate 63 located above the eccentric wheel 62 is slidably mounted on the slide tracks 615 at the inner side of the gear seat 61, and is retained by the slide tracks 615 at the outer side of the gear seat 61. The slide plate 63 has a center formed with an oblong slot 631 in which the eccentric shaft 621 of the eccentric wheel 62 is received, and provided with a threaded post 632 located beside the oblong slot 631 and received in the oblong slot 532 of each of the two arm skeletons 53. The slide plate 63 has a rear end formed with a small hole 633 and having a bottom provided with a push plate 634.

The drive block 64 is screwed on a top of the threaded post 632 of the slide plate 63 by a screw member Z, and has two sides each provided with a tapered drive plate 641.

The two upper body connecting frames 65 are symmetrically screwed on the top of the gear seat 61. Each of the two upper body connecting frames 65 has a bottom provided with two threaded posts 651 matingly screwed on the short threaded posts 616 of the gear seat 61, and a sleeve 652 located between the two threaded posts 651. The positioning rod 531 at the top of each of the two arm skeletons 53 is mounted in the sleeve 652 of each of the two upper body connecting frames 65. The bottom of each of the two upper body connecting frames 65 is provided with two limit rods 653 that are slightly spaced from the slide plate 63. Each of the two upper body connecting frames 65 has a top provided with an upright plate 654 formed with a circular hole 6541 for passage of a passage rod 655.

Figure 10:
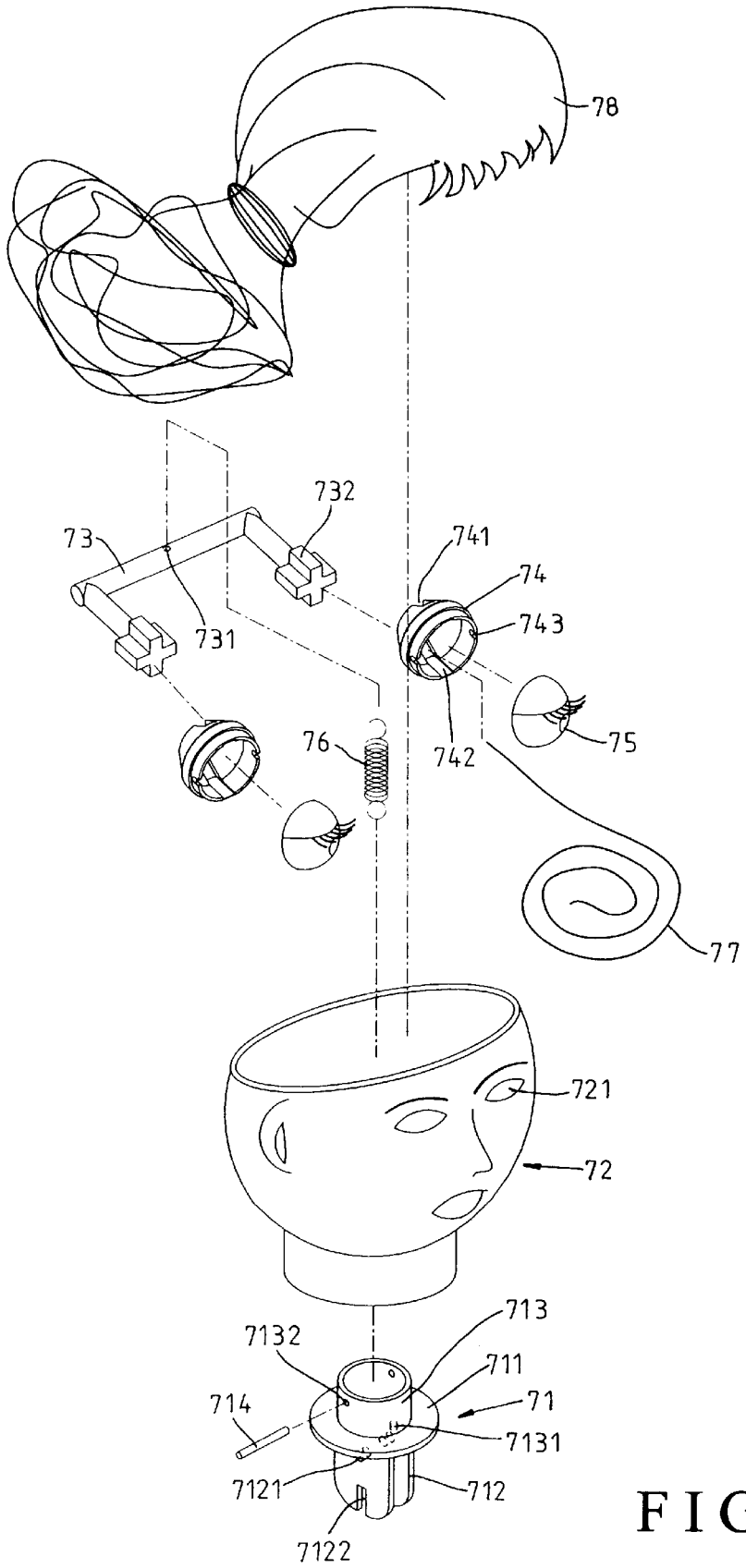
FIG. 10 is an exploded perspective view of a head of the prayer doll toy structure in accordance with a preferred embodiment of the present invention.

As shown in FIG. 9 and 10, the head 7 is mounted above the upper body skeleton 5, and includes a head fixing rack 71, a head housing 72, an eye-socket rack 73, two eye sockets 74, two eyeballs 75, a tensile spring 76, a pull rope 77, and hair 78.

The head fixing rack 71 includes a circular plate 711 having a bottom provided with two parallel rack plates 712 each rested on the inner side of the upright plate 654 of each of the two upper body connecting frames 65. Each of the two parallel rack plates 712 has an upper end formed with a mounting hole 7121 aligned with the circular hole 6541 of the upright plate 654 of each of the two upper body connecting frames 65 for passage of the passage rod 655, so that the head fixing rack 71 may be fixed on the two upper body connecting frames 65. Each of the two parallel rack plates 712 has a lower end formed with a slit 7122 for receiving the two drive plates 641 of the drive block 64 as shown in FIG. 9. A transverse bolt rod 7123 is mounted between the two parallel rack plates 712. The circular plate 711 of the head fixing rack 71 has a top provided with a ring seat 713 having a lower portion formed with a small hole 7131, and an upper portion formed with two opposite through holes 7132 for passage of a transverse rod 714.

The head housing 72 is a hollow housing and formed with two spaced eye holes 721.

The eye-socket rack 73 is a substantially U-shaped rack that is mounted in the head housing 72 horizontally. The eye-socket rack 73 has a mediate section formed with a hook hole 731, and has two distal ends each secured with a cross-shaped protruding rib 732.

Each of the two eye sockets 74 is a cone-shaped hollow body, and has a rear end formed with a cross-shaped recess 741 for receiving the protruding rib 732 of the eye-socket rack 73. Each of the two eye sockets 74 has a lower edge having a center formed with a channel 742, and has two sides each having a front edge formed with a cavity 743.

Each of the two eyeballs 75 is mounted on the front end of the eye socket 74, and is fixed by a screw member Z which is screwed into the cavity 743 of each of the two sides of the eye socket 74. Each of the two eyeballs 75 has a front portion received in the eye hole 721 of the head housing 72.

The tensile spring 76 has an upper end secured in the hook hole 731 of the eye-socket rack 73, and a lower end secured on the transverse rod 714 of the ring seat 713 of the head fixing rack 71.

The pull rope 77 has a first end passed through the channel 742 of the eye socket 74 and secured on the eye socket 74 as shown in FIGS. 3 and 9. The pull rope 77 has a second end in turn passed through the small hole 7131 of the ring seat 713 of the circular plate 71 of the head fixing rack 71, the transverse bolt rod 7123 between the two parallel rack plates 712, the drive block 64 between the two drive plates 641, and through the small hole 633 of the slide plate 63, and is finally secured on a rear portion of the gear seat 61 by a screw member Z as shown in FIG. 9.

The hair 78 is bonded on the top of the head housing 72.

As shown in FIG. 2, the shade 8 is mounted on the lower body skeleton 3 and the lower body drive set 4.

In operation, the push button 125 on the base 1 may be pressed to conduct the electric power. Then, the first motor 22 of the base drive set 2 may be operated to in turn drive and rotate the first reduction gear a, the second reduction gear b, the third reduction gear c, the fourth reduction gear d and the fifth reduction gear e mounted in the gear box 21. The fifth reduction gear e may then drive and rotate the co-axial transfer gear 23 which may drive and rotate the gear 41 of the lower body drive set 4.

Figure 11:
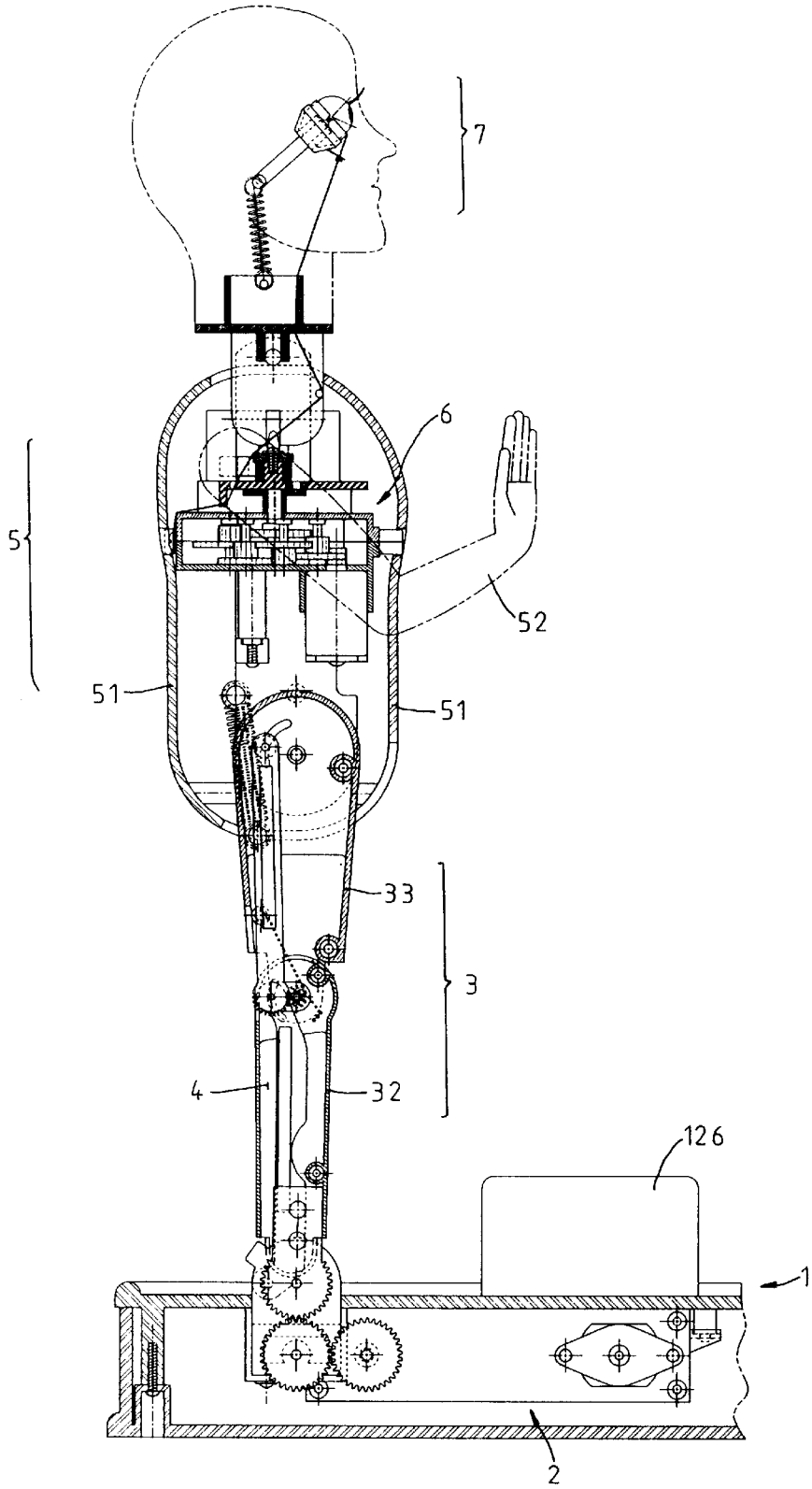
FIG. 11 is a side plan cross-sectional assembly view of the prayer doll toy structure as shown in FIG. 1.
Figure 12:
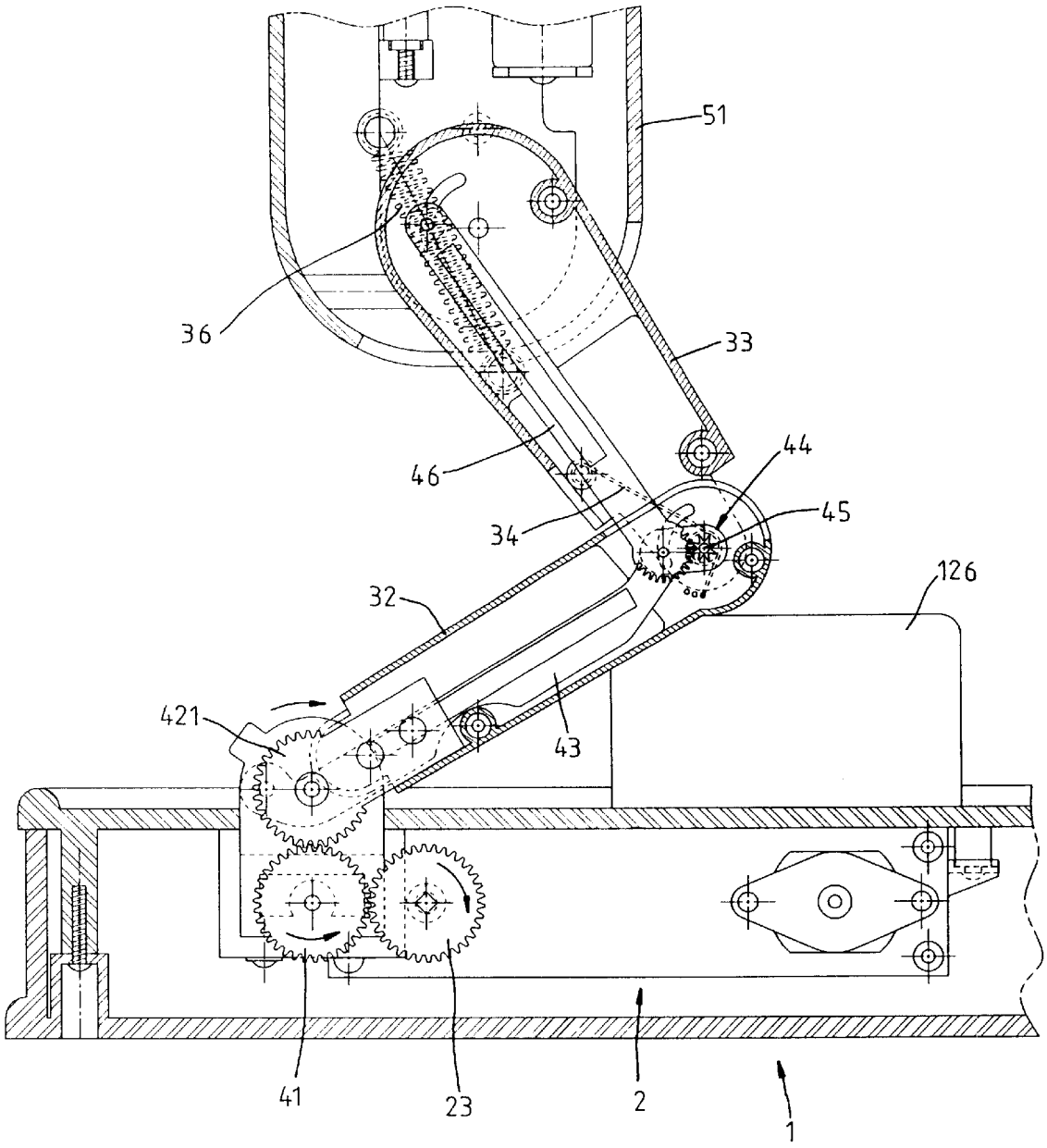
FIG. 12 is a schematic operational view of the prayer doll toy structure as shown in FIG. 11 in use.
Figure 13:
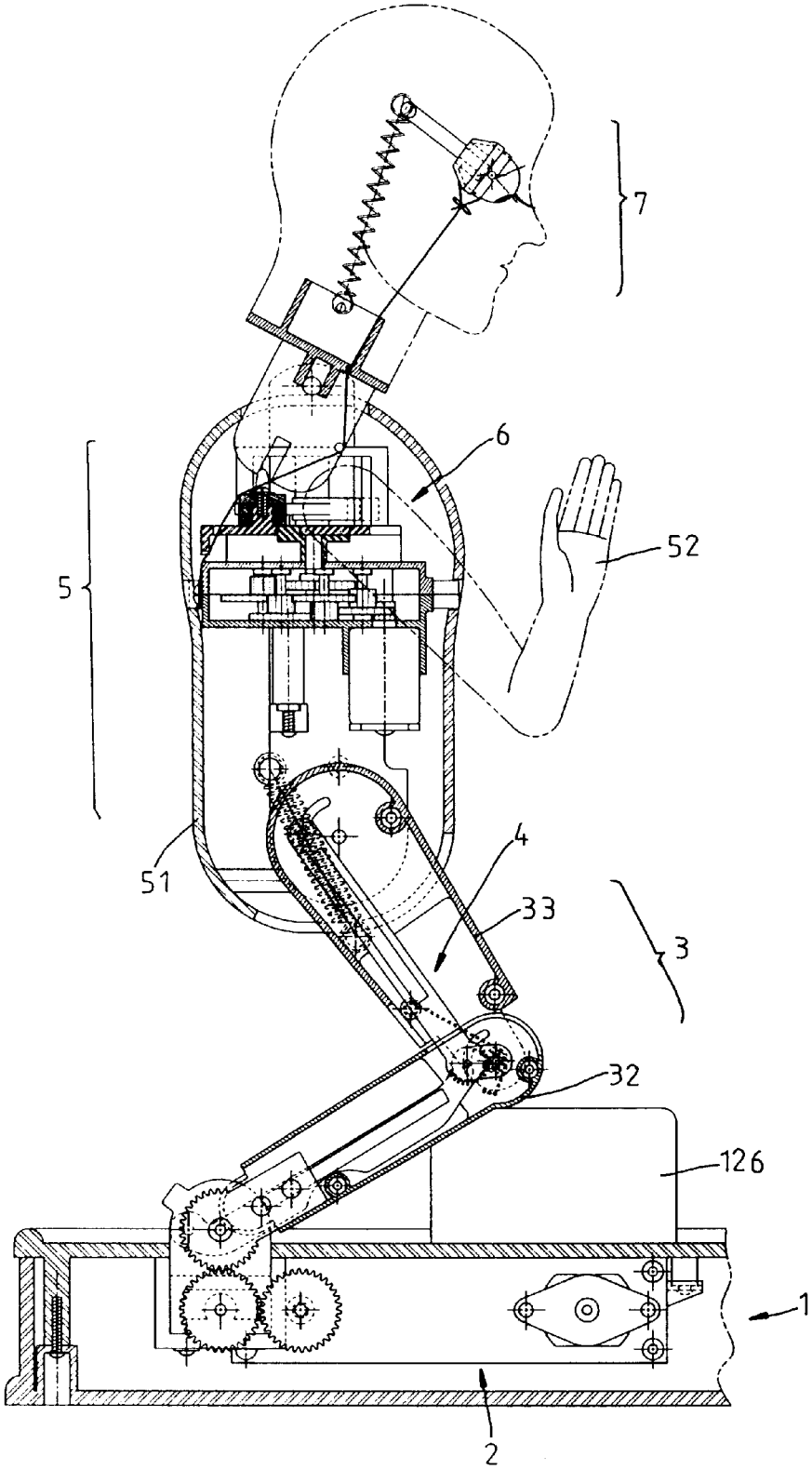
FIG. 13 is a schematic operational view of the prayer doll toy structure as shown in FIG. 11 in use.

As shown in FIGS. 11 and 12, the gear may then drive and rotate the meshing sector-shaped teeth 421 of the sector-shaped plate 42 which drive the shank cover 32 to pivot forward, thereby in turn moving the lower link 43, the connecting plate 44, the pinion 45 and the upper link 46 of the-lower body drive set 4, so that the thigh cover 33 may be bent simultaneously. Thus, the lower body skeleton 3 may simulate the human body to kneel on the pad 126 as shown in FIG. 13.

Figure 14:
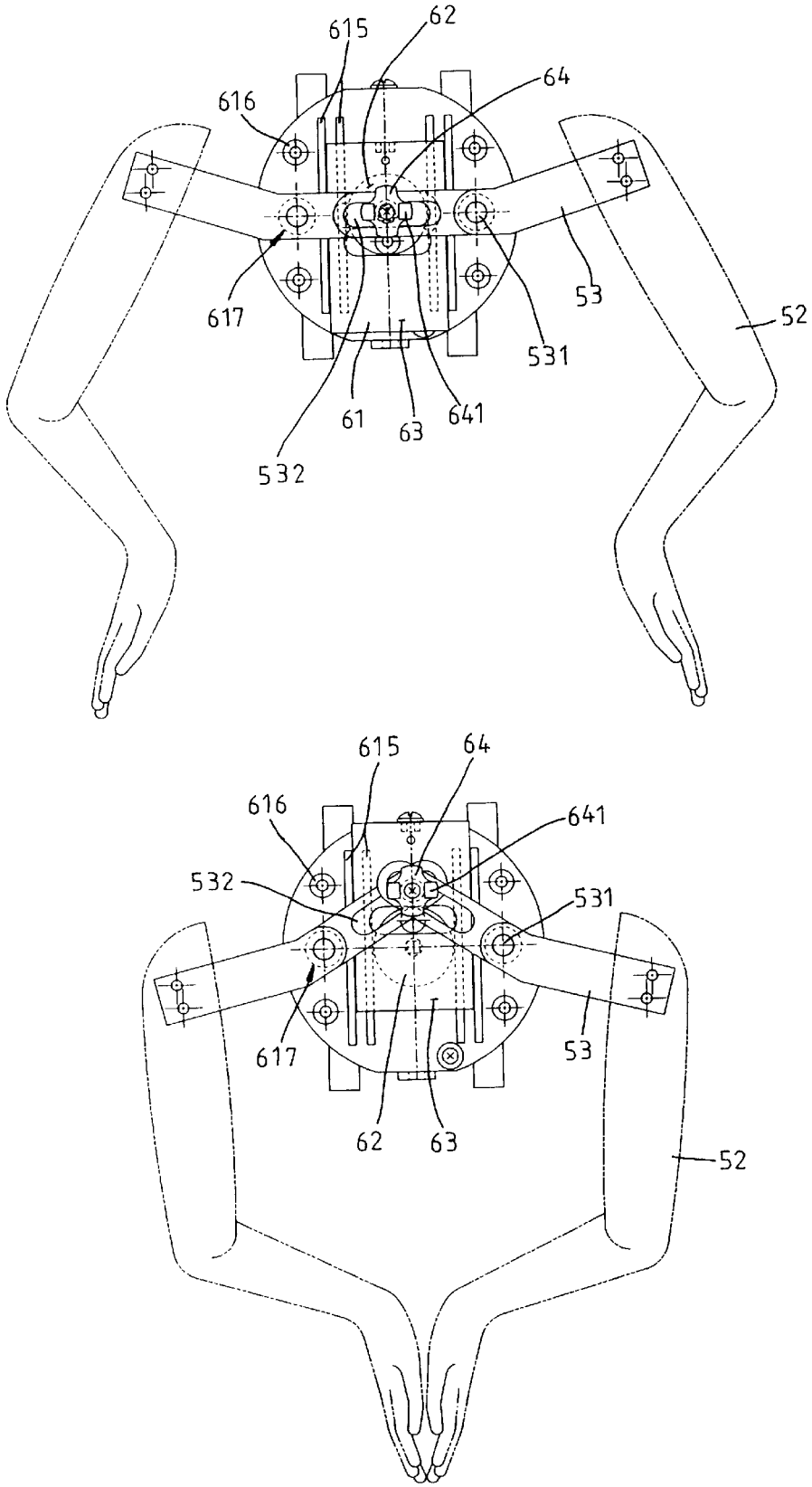
FIG. 14 is a schematic top plan operational view of the prayer doll toy structure of the prayer doll toy structure in accordance with a preferred embodiment of the present invention.

Afterward, the second motor 614 of the upper body drive set 6 may be operated to in turn to drive and rotate the sixth reduction gear f, the seventh reduction gear g, the eighth reduction gear h, the ninth reduction gear i, the tenth reduction gear j and the eleventh reduction gear k. Then, the eleventh reduction gear k may drive and rotate the co-axial eccentric wheel 62 which eccentrically rotates the eccentric shaft 621 to drive the slide plate 63 to move reciprocally on the gear seat 61 between the slide tracks 615. At the same time, the threaded post 632 on the slide plate 63 may drive each of the two arm skeletons 53 to pivot reciprocally as shown in FIG. 14, so as to simulate the human body to pray.

Figure 15:
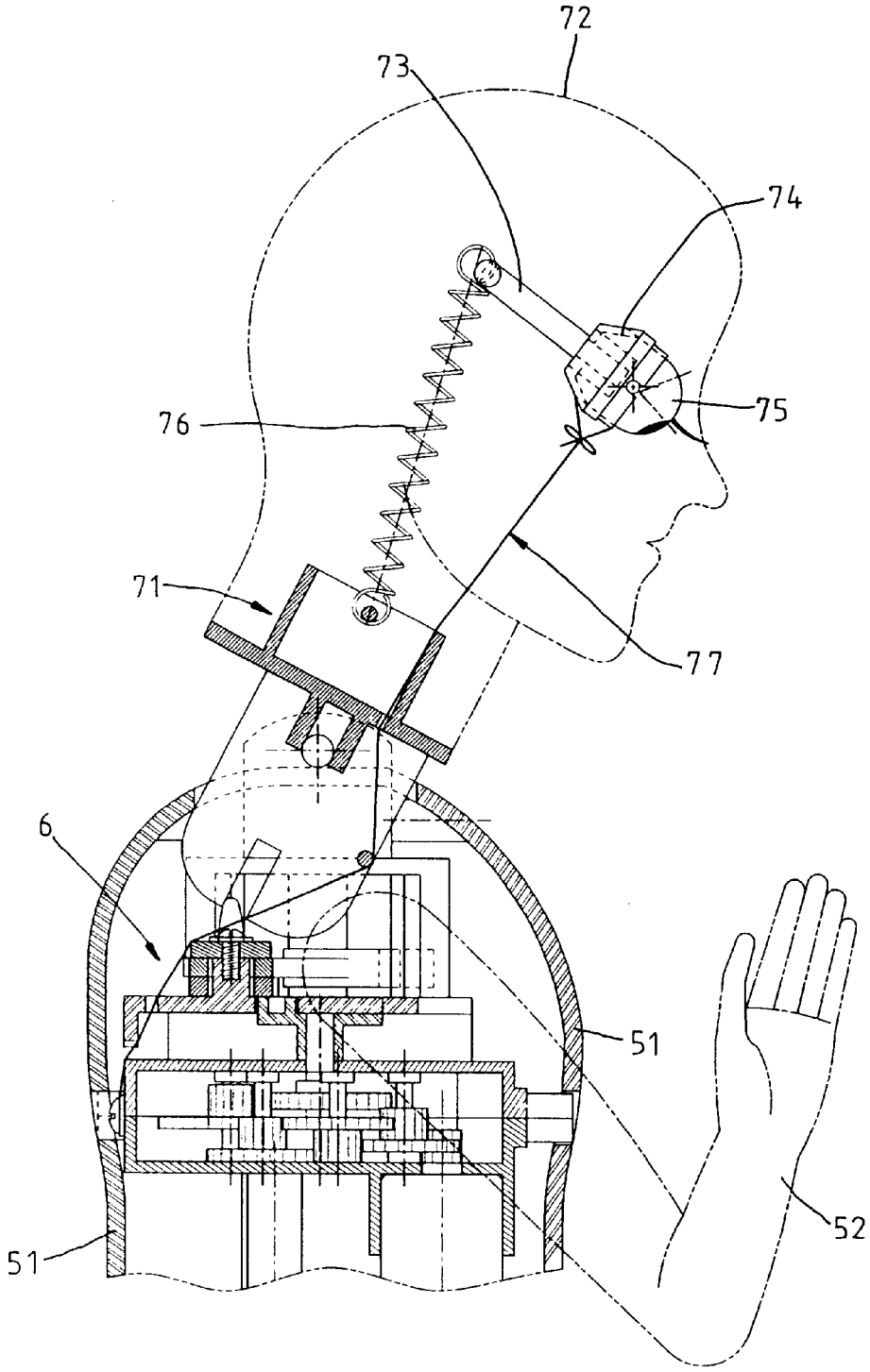
FIG. 15 is a schematic operational view of the prayer doll toy structure as shown in FIG. 11 in use.

The drive block 64 mounted on the top of the threaded post 632 of the slide plate 63 may also be moved with the threaded post 632 of the slide plate 63 reciprocally, so that the drive plates 641 secured in the slits 7122 of the two parallel rack plates 712 of the head fixing rack 71 may be moved reciprocally, thereby pivoting the head housing 72 of the head downward and upward as shown in FIG. 15.

In addition, movement of the slide plate 63 will draw the pull rope 77 secured on the ear socket 74 and the gear seat 61, so that the pull rope 77 may pull the eye-socket rack 73 to pivot downward and upward, and the eye ball 75 may be opened and closed in the eye hole 721 of the head housing 72.

Figure 16:
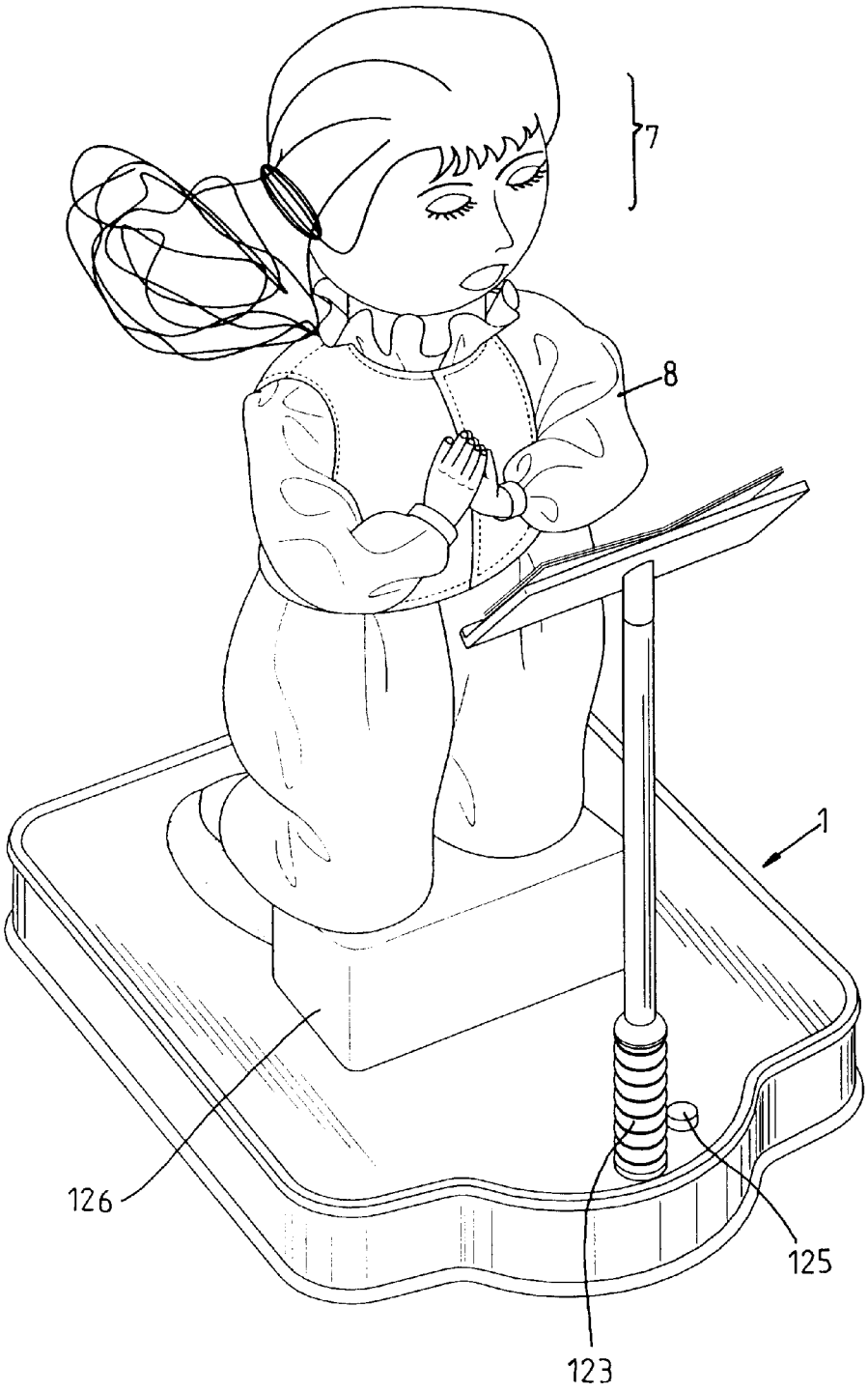
FIG. 16 is a schematic operational view of the prayer doll toy structure as shown in FIG. 2 in use.

Thus, by combining the above-mentioned operations, the prayer doll toy structure in accordance with a preferred embodiment of the present invention may kneel on the pad as shown in FIG. 16, to simulate the human body to pray, thereby achieving an amusement effect.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A prayer doll toy structure, comprising: a base, a base drive set, a lower body skeleton, a lower body drive set, an upper body skeleton, an upper body drive set, a head, and a shade, wherein:

the base includes a base lower case, and a base cover plate, the base lower case has an inside formed with a battery chamber facing downward, the base cover plate is secured on a top of the base lower case and has a rear edge formed with two rectangular recesses, each of the two rectangular recesses has a front side wall and a bottom side wall each formed with an opening;

the base drive set is mounted in the base, and is screwed on a bottom of the base cover plate, the base drive set includes a gear box that is divided into two halves, the gear box is provided with a first motor which can drive and rotate two belt wheels by a belt mounted outside of the gear box, to in turn drive and rotate a first reduction gear, a second reduction gear, a third reduction gear, a fourth reduction gear, and a fifth reduction gear mounted in the gear box, the fifth reduction gear can drive and rotate two transfer gears that are mounted outside of the gear box, and are co-axial with the fifth reduction gear, each of the two transfer gears is received in the opening of each of the two rectangular recesses of the base cover plate;

the lower body skeleton is a two-leg structure symmetrically fixed above the base, and includes two positioning blocks, two shank covers, two thigh covers, two torsion springs, two frame plates, and a tensile spring;

the two positioning blocks are symmetrically secured in the rectangular recess of the base cover plate, the two positioning blocks are matingly provided with a threaded post and a screw bore, and are matingly provided with a lug and a cavity located above the threaded post and the screw bore respectively, one of the two positioning blocks has an outer side having an edge provided with a tube;

each of the two shank covers is provided with a concave joint portion which has a center formed with a through hole for passage of a spindle, the joint portion is formed with an arcuate slot for passage of a passage rod, and multiple insertion holes arranged in a curved manner;

each of the two thigh covers has an inner side having a lower end having a center provided with a circular lug formed with a central hole for passage of a spindle, so that the two thigh covers can be pivoted on the two shank covers, each of the two thigh covers is provided with a short post located above the circular lug, each of the two thigh covers has an upper end having a center formed with a screw bore into which a screw member is screwed, one of the two thigh covers is formed with an arcuate slot, and is provided with a stepped threaded rod located under the arcuate slot;

the torsion spring is mounted between the shank cover and the thigh cover, and has a mediate section mounted on the circular lug of the thigh cover, the torsion spring has an upper section formed with a ring secured on the short post, the torsion spring has a lower section which is inserted into the insertion hole of the joint portion of the shank cover;

the two frame plates are mounted above the thigh covers, and are connected with each other by a threaded post, the frame plate has a lower end formed with a screw bore which is aligned with the screw bore of the thigh cover for passage of a screw member, so that the frame plate can be secured on the thigh cover, the frame plate is formed with a circular hole, the circular hole is aligned with the arcuate slot of one thigh cover for passage of a short rod, the frame plate has an inner side having an edge and has an outer side having a center each secured with a U-shaped block, an inner side of one frame plate is provided with a stepped threaded rod located under the U-shaped block;

the tensile spring has an upper end formed with a ring mounted on the stepped threaded rod of one frame plate, and a lower end formed with a ring mounted on the stepped threaded rod of one thigh cover;

the lower body drive set is mounted in the lower body skeleton, and includes a gear, a sector-shaped plate, a lower link, a connecting plate, a pinion, and an upper link;

the gear has a center mounted on the threaded post of the positioning block, and meshes with the transfer gear of the base drive set;

the sector-shaped plate has a lower end pivotally mounted on the lug of the positioning block, and provided with multiple sector-shaped teeth meshing with the gear, the sector-shaped plate has an upper end formed with two screw bores for passage of screw members, so that the sector-shaped plate can be secured with a lower end of one shank cover;

the lower link is mounted in the shank cover, and has a lower end formed with a mounting hole mounted on the tube of one positioning block, and an upper end for passage of the passage rod of the joint portion of the shank cover;

the connecting plate is mounted on the upper end of the lower link, and has two ends each formed with a circular hole for passage of the spindle and the passage rod;

the pinion is mounted beside the connecting plate, and has a center mounted on the spindle;

the upper link is mounted in the thigh cover, and has a lower end mounted on the passage rod of the shank cover and formed with multiple engaging teeth meshing with the pinion, and an upper end mounted on the short rod which is extended through the arcuate slot of the thigh cover;

the upper body skeleton is mounted above the lower body skeleton, and includes two upper body casings, two arms, and two arm skeletons;

the two upper body are provided with multiple threaded posts for passage of screw members, for securing the two upper body casings, each of the two upper body casings has a mediate section formed with two spaced through holes, an upper section formed with an upper cutout, and two sides each formed with a side cutout;

each of the two arms has a root portion formed with a concave, the root portion of each of the two arms has an inner side formed with a cutout located under the concave;

each of the two arm skeletons has a front section received in the cutout of the arm, each of the two arm skeletons has a mediate section having a top and a bottom each protruded with a positioning rod, each of the two arm skeletons has a rear section formed with an oblong slot;

the upper body drive set is mounted in the upper body casings of the upper body skeleton, and includes a gear seat, an eccentric wheel, a slide plate, a drive block, and two upper body connecting frames;

the gear seat is provided with multiple plunger rods that can be inserted into the through holes of the upper body casings of the upper body skeleton, thereby achieving a positioning effect, the gear seat has a bottom provided with multiple long threaded posts screwed on the U-shaped blocks of the frame plates, so that the gear seat can be secured on the frame plates, an upright second motor is mounted between two long threaded posts, for driving and rotating a sixth reduction gear, a seventh reduction gear, an eighth reduction gear, a ninth reduction gear, a tenth reduction gear, and an eleventh reduction gear that are mounted in the gear seat, the gear seat has a top having two sides each provided with two parallel slide tracks, wherein an outer slide track is higher than an inner slide track, a top of the gear seat has four corners provided with four short threaded posts located outside of the slide tracks, the top of the gear seat is provided with two sleeves each located between two adjacent short threaded posts, the positioning rod at a bottom of each of the two arm skeletons is mounted in the sleeve;

the eccentric wheel is mounted on the top of the gear seat, and is co-axial with the eleventh reduction gear, an eccentric shaft is secured on a periphery of a top of the eccentric wheel;

the slide plate is slidably mounted on the slide tracks at an inner side of the gear seat, and is retained by the slide tracks at an outer side of the gear seat, the slide plate has a center formed with an oblong slot in which the eccentric shaft of the eccentric wheel is received, and provided with a threaded post located beside the oblong slot and received in the oblong slot of each of the two arm skeletons, the slide plate has a rear end formed with a small hole and having a bottom provided with a push plate;

the drive block is screwed on a top of the threaded post of the slide plate, and has two sides each provided with a tapered drive plate;

the two upper body connecting frames are symmetrically screwed on the top of the gear seat, each of the two upper body connecting frames has a bottom provided with two threaded posts matingly screwed on the short threaded posts of the gear seat, and a sleeve located between the two threaded posts, the positioning rod at a top of each of the two arm skeletons is mounted in the sleeve of each of the two upper body connecting frames, a bottom of each of the two upper body connecting frames is provided with two limit rods that are spaced from the slide plate, each of the two upper body connecting frames has a top provided with an upright plate formed with a circular hole for passage of a passage rod;

the head is mounted above the upper body skeleton, and includes a head fixing rack, a head housing, an eye-socket rack, two eye sockets, two eyeballs, a tensile spring, a pull rope, and hair;

the head fixing rack includes a circular plate having a bottom provided with two parallel rack plates each rested on an inner side of the upright plate of each of the two upper body connecting frames, each of the two parallel rack plates has an upper end formed with a mounting hole aligned with the circular hole of the upright plate of each of the two upper body connecting frames for passage of the passage rod, so that the head fixing rack can be fixed on the two upper body connecting frames, each of the two parallel rack plates has a lower end formed with a slit for receiving the two drive plates of the drive block, a transverse bolt rod is mounted between the two parallel rack plates, the circular plate of the he ad fixing rack has a top provided with a ring seat having a lower portion formed with a small hole, and an upper portion formed with two opposite through holes for passage of a transverse rod;

the head housing is formed with two spaced eye holes;

the eye-socket rack is mounted in the head housing and has a mediate section formed with a hook hole, and has two distal ends each secured with a cross-shaped protruding rib;

each of the two eye sockets has a rear end formed with a cross-shaped recess for receiving the protruding rib of the eye-socket rack, each of the two eye sockets has a lower edge having a center formed with a channel, and has two sides each having a front edge formed with a cavity;

each of the two eyeballs is mounted on the front end of the eye socket, and is fixed by a screw member which is screwed into the cavity of each of the two sides of the eye socket, each of the two eyeballs has a front portion received in the eye hole of the head housing;

the tensile spring h as an upper end secured in the hook hole of the eye-socket rack, and a lower end secured on the transverse rod of the ring seat of the head fixing rack;

the pull rope has a first end passed through the channel of the eye socket and secured on the eye socket, the pull rope has a second en d in turn passed through the small hole of the ring seat of the circular plate of the head fixing rack, the transverse bolt rod between the two parallel rack plates, the drive block between the two drive plates, and through the small hole of the slide plate, and is secured on a rear portion of the gear seat.

2. The prayer doll toy structure in accordance with claim 1, wherein the inside of the base lower case is provided with a horn located beside the battery chamber.

3. The prayer doll toy structure in accordance with claim 1, wherein the inside of the base lower case is provided with multiple threaded posts, and the base cover plate has a bottom provided with multiple threaded posts aligned with the threaded posts of the base lower case for passage of multiple screw members, thereby combining the base lower case with the base cover plate.

4. The prayer doll toy structure in accordance with claim 1, wherein the base cover plate has a front edge having a center formed with an insertion hole for insertion of a shelf.

5. The prayer doll toy structure in accordance with claim 4, wherein the front edge of the base cover plate is formed with a circular hole located beside the insertion hole for passage of a push button from a lower side.

6. The prayer doll toy structure in accordance with claim 1, further comprising a rectangular pad secured on a mediate section of the base cover plate.

7. The prayer doll toy structure in accordance with claim 1, wherein each of the two positioning blocks is L-shaped.

8. The prayer doll toy structure in accordance with claim 1, wherein the inner side of each of the two thigh covers is provided with multiple threaded posts into which multiple screw members can be screwed to fix the two thigh covers.

9. The prayer doll toy structure in accordance with claim 1, wherein the ring of the upper section of the torsion spring is secured on the short post located above the circular lug of the thigh cover by a screw member, thereby fixing the upper section of the torsion spring.

10. The prayer doll toy structure in accordance with claim 1, wherein the lower section of the torsion spring is bent with 90 degrees.

11. The prayer doll toy structure in accordance with claim 1, wherein the connecting plate is an oblong plate.

12. The prayer doll toy structure in accordance with claim 1, wherein the two upper body casings are combined with each other to form the upper body of the doll.

13. The prayer doll toy structure in accordance with claim 1, wherein each of the two arm skeletons is a substantially V-shaped plate that is connected with the respective arm.

14. The prayer doll toy structure in accordance with claim 1, further comprising a screw member extended through the concave and screwed into the front section of each of the two arm skeletons, thereby securing the arm on the front section of each of the two arm skeletons.

15. The prayer doll toy structure in accordance with claim 1, wherein the gear seat is a circular hollow housing that is divided into an upper half and a lower half which can be combined with each other.

16. The prayer doll toy structure in accordance with claim 1, wherein the drive block is screwed on the top of the threaded post of the slide plate by a screw member.

17. The prayer doll toy structure in accordance with claim 1, wherein the head housing is a hollow housing.

18. The prayer doll toy structure in accordance with claim 1, wherein the eye-socket rack is a substantially U-shaped rack that is mounted in the head housing horizontally.

19. The prayer doll toy structure in accordance with claim 1, wherein each of the two eye sockets is a cone-shaped hollow body.

20. The prayer doll toy structure in accordance with claim 1, wherein the second end of the pull rope is secured on the rear portion of the gear seat by a screw member.

* * * * *